US009041640B2

(12) United States Patent
Seo et al.

(10) Patent No.: US 9,041,640 B2
(45) Date of Patent: May 26, 2015

(54) DISPLAY DRIVER AND MANUFACTURING METHOD THEREOF

(75) Inventors: Myung-Ho Seo, Hwaseong-si (KR); Hyungtae Kim, Gyeonggi-do (KR)

(73) Assignee: Samsung Electronics Co., LTD., Suwon-Si, Gyeonggi-do (KR)

( * ) Notice: Subject to any disclaimer, the term of this patent is extended or adjusted under 35 U.S.C. 154(b) by 242 days.

(21) Appl. No.: 13/617,748

(22) Filed: Sep. 14, 2012

(65) Prior Publication Data

US 2013/0147699 A1 Jun. 13, 2013

(30) Foreign Application Priority Data

Dec. 12, 2011 (KR) ..... 10-2011-0133032

(51) Int. Cl.
*G09G 3/36* (2006.01)
*G09G 3/00* (2006.01)

(52) U.S. Cl.
CPC ..... *G09G 3/3688* (2013.01); *G09G 3/006* (2013.01); *G09G 2300/0426* (2013.01)

(58) Field of Classification Search
CPC ..... G09G 2330/12; G09G 2310/0291; G09G 3/3688; G09G 3/006
USPC ..... 345/100, 204
See application file for complete search history.

(56) References Cited

U.S. PATENT DOCUMENTS 6,051,634 A 4/2000 Laas et al.
6,421,037 B1 7/2002 Chen
6,879,174 B2 4/2005 Uchida
6,956,378 B2 * 10/2005 Morita ..... 324/523
7,760,199 B2 7/2010 An
7,915,906 B2 3/2011 Hashimoto
2003/0025658 A1 2/2003 Janssen et al.
2006/0256052 A1 * 11/2006 Udo et al. ..... 345/87
2006/0267625 A1 11/2006 Kaneko
2007/0080913 A1 * 4/2007 Park et al. ..... 345/87
2008/0100331 A1 * 5/2008 Qi ..... 324/770
2008/0170197 A1 * 7/2008 Byun et al. ..... 349/189
2010/0241957 A1 9/2010 Kim et al.
2010/0282169 A1 * 11/2010 Lee et al. ..... 118/723 R
2011/0148893 A1 6/2011 An et al.
2011/0199397 A1 * 8/2011 Ko et al. ..... 345/212
2012/0086679 A1 * 4/2012 Hwang et al. ..... 345/204

FOREIGN PATENT DOCUMENTS

EP 0772861 B1 9/2003
JP 05303356 11/1993
JP 11231281 8/1999

(Continued)

*Primary Examiner* — Allison Johnson
(74) *Attorney, Agent, or Firm* — F. Chau & Associates, LLC

(57) ABSTRACT

Disclosed is a display driver which includes a serial-to-parallel converter outputting parallel RGB data in response to a clock and serial RGB data, a shift register unit sequentially shift the clock to store the shifted clocks, a data latch unit receiving the parallel RGB data based on the shifted clocks, a digital-to-analog converter converting data stored in the data latch unit to analog data using gamma reference voltages, and an output buffer unit outputting the converted analog data to corresponding output pads. The output buffer unit includes sharing switches respectively corresponding to the output pads, the output pads are connected to sharing pads via the sharing switches, and the sharing pads are interconnected via a film having a conductive material.

13 Claims, 9 Drawing Sheets

(56) References Cited

FOREIGN PATENT DOCUMENTS

| | | | |
|---|---|---|---|
| JP | 2004264349 | | 9/2004 |
| JP | 2006196584 | | 7/2006 |
| JP | 2009092695 | | 4/2009 |
| KR | 1019990029772 | A | 4/1999 |
| KR | 1020000075119 | A | 12/2000 |
| KR | 1020030064467 | A | 8/2003 |
| KR | 1020070046238 | A | 5/2007 |

* cited by examiner

DISPLAY DRIVER AND MANUFACTURING METHOD THEREOF

CROSS-REFERENCE TO RELATED APPLICATIONS

A claim for priority under 35 U.S.C §119 is made to Korean Patent Application No. 10-2011-0133032 filed Dec. 12, 2011, the entirety of which is incorporated by reference herein.

BACKGROUND

Embodiments of the inventive concept described herein relate to a display driver and a manufacturing method thereof.

Liquid crystal displays are widely used in notebook computers, televisions, and the like. A liquid crystal display device of an active matrix type uses thin film transistors (TFTs) as switch elements and is suitable for displaying moving pictures.

A TFT type display device includes a display panel unit for displaying image signals, a driver circuit unit for displaying the image signals onto the display, and a power supply for powering the display panel unit and the driver circuit unit.

SUMMARY

An exemplary embodiment of the inventive concept provides a display driver comprising a serial-to-parallel converter outputting parallel RGB data in response to a clock and serial RGB data, a shift register unit sequentially shift the clock to store the shifted clocks, a data latch unit receiving the parallel RGB data based on the shifted clocks, a digital-to-analog converter converting the parallel RGB data stored in the data latch unit to analog data using gamma reference voltages, and an output buffer unit outputting the converted analog data to corresponding output pads, wherein the output buffer unit includes sharing switches respectively corresponding to the output pads, the output pads are connected to sharing pads via the sharing switches, and the sharing pads are connected to each other via a film having a conductive material.

In an exemplary embodiment, the digital-to-analog converter alternately outputs a positive voltage and a negative voltage corresponding to the converted analog data in response to a polarity signal. The positive voltage is higher than a reference voltage, and the negative voltage is lower than the reference voltage.

In an exemplary embodiment, the sharing switches share charges of the output pads or are used at a test operation on channels respectively corresponding to the output pads.

In an exemplary embodiment, the test operation includes an electrical die sorting (EDS) test operation of a wafer level.

In an exemplary embodiment, the test operation includes testing odd channels of the channels respectively corresponding to the output pads using the sharing pads and testing even channels of the channels respectively corresponding to the output pads using the sharing pads.

In an exemplary embodiment, the sharing pads are connected to each other by the film when the display driver is assembled after the test operation.

In an exemplary embodiment, at least two sharing switches of the sharing switches are connected to one of the sharing pads.

In an exemplary embodiment, the output buffer unit includes output buffers respectively corresponding to the output pads. Each of the output buffers comprises an amplifier having a positive input terminal receiving the analog data and a negative input terminal connected to an output terminal, an output switch connected to the output terminal and outputting an output of the amplifier to a corresponding output pad in response to a switching control signal, and a sharing switch connected to the output pad and connecting the output pad to a corresponding sharing pad in response to a sharing control signal.

In an exemplary embodiment, a first channel corresponding to a first output pad and a second channel corresponding to a second output pad are connected to one of the sharing pads.

In an exemplary embodiment, the number of the sharing pads is 6.

In an exemplary embodiment, the sharing pads are disposed outside an internal chip of the display driver.

In an exemplary embodiment, when the sharing pads are connected to each other by the film, at least one dummy pad is connected with the sharing pads.

In an exemplary embodiment, the film has a resistance value below about 2.16Ω.

An exemplary embodiment of the inventive concept also provides a method of manufacturing a display driver comprising performing a test operation on channels using at least two sharing switches respectively corresponding to sharing pads, and connecting the sharing pads to each other via a film having a conductive material at an assemble operation executed after the test operation.

In an exemplary embodiment, performing the test operation comprises performing a test operation on odd channels of the channels, and performing a test operation on even channels of the channels.

According to an embodiment, there is provided a display driver including a plurality of sharing switches, wherein at least one of the sharing switches is connected to an output switch and an output pad and a plurality of sharing pads, wherein at least two of the sharing switches are jointly connected to at least one of the sharing pads, and wherein the sharing pads are connected to each other via a conductive member.

The display driver does not include test switches.

The conductive member includes a conducive film.

BRIEF DESCRIPTION OF THE FIGURES

The embodiments will become apparent from the following description with reference to the following figures, wherein.

DETAILED DESCRIPTION

Figure 1:
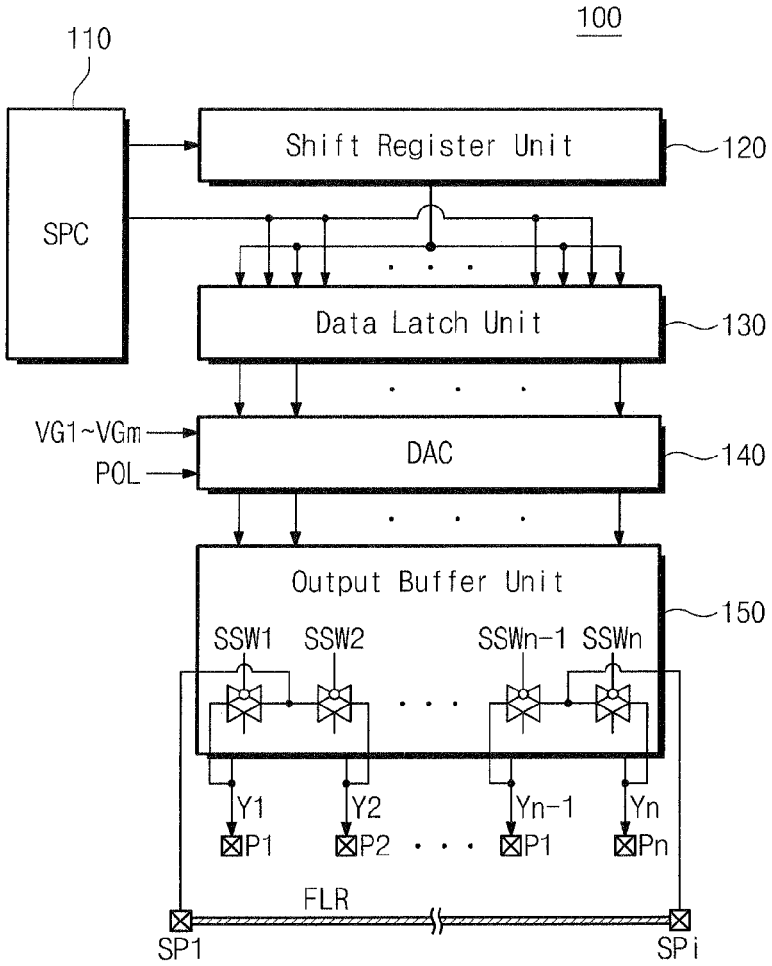
FIG. 1 is a block diagram schematically illustrating a display driver according to an embodiment of the inventive concept.

Embodiments of the inventive concept are described in detail hereinafter with reference to the accompanying drawings, in which the same reference numerals may be used to denote the same or substantially the same elements throughout the specification and the drawings. This inventive concept may, however, be embodied in many different forms and should not be construed as limited to the embodiments set forth herein.

FIG. 1 is a block diagram schematically illustrating a display driver according to an embodiment of the inventive concept. Referring to FIG. 1, a display driver 100 includes a serial-to-parallel converter 110, a shift register unit 120, a data latch unit 130, a digital-to-analog converter 140, and an output buffer unit 150.

The serial-to-parallel converter 110 receives at least one clock and RGB (Red, Green, and Blue) data as serialized low-voltage differential signals and converts the RGB data to parallelize RGB data.

The shift register unit 120 sequentially shifts the clock provided from the serial-to-parallel converter 110. The clock may be used to synchronize an output of the shift register unit 120.

The data latch unit 130 may include a plurality of latch circuits (not shown). Each of the latch circuits may receive a clock and parallelized RGB data output from the shift register unit 120. The latch circuits of the data latch unit 120 sequentially stores the parallelized RGB data based on shifted clocks.

The digital-to-analog converter 140 converts the parallelized RGB data (corresponding to a gate line) in the data latch unit 130 to analog data (referred to as gray scale voltages) using gamma reference voltages VG1 to VGk (k is a natural number). The digital-to-analog converter 140 alternately outputs a positive voltage and a negative voltage, which correspond to the converted analog data, in response to a polarity signal POL. The positive voltage is higher than a reference voltage, and the negative voltage is lower than the reference voltage. The output buffer unit 150 may include a plurality of output buffers (not shown). Each of the output buffers may include an amplifier that outputs analog data converted by the analog converter 140 to a corresponding pixel.

In an exemplary embodiment, each of the output buffers may have a 2-channel driving structure. The 2-channel driving structure is in detail disclosed in U.S. Patent Publication No. 2011-0148893, the entirety of which is incorporated by reference herein.

The output buffers output driving signals Y1 to Yn via a plurality of output pads P1 to Pn (n is an integer more than 1 and indicates the number of the output buffers).

The output buffers include sharing switches SSW1 to SSWn for sharing charges of corresponding output lines. A charge sharing scheme is in detail disclosed in U.S. Patent Publication No. 2006/0279356, the entirety of which is incorporated by reference herein.

At least two of the sharing switches SSW1 to SSWn are connected to at least one of sharing pads SP1 to SPi (i is an integer more than 1 and equal to or less than n). For example, as illustrated in FIG. 1, first and second sharing switches SSW1 and SSW2 are connected to a first sharing pad SP1.

The sharing switches SSW1 to SSWn can be used as test switches at a test operation of a wafer level.

The sharing pads SP1 to SPi may be connected to each other via a film (e.g., film level routing (FLR)) having a conductive material. For ease of description, the film having a conductive material may be referred to as FLR. As shown in FIG. 1, the sharing pads SP1 to SPi are connected to each other via the FLR. According to an embodiment, at least two groups of sharing pads are connected to each other via the FLR.

In an exemplary embodiment, the FLR may have a resistance value below about 2.16Ω.

The film having a conductive material illustrated in FIG. 1 is not limited to the FLR. The film can be formed of a tape automated bonding (TAB) having a conductive material according to an embodiment of the inventive concept or a film that may implement a tape carrier package (TCP) in a chip on film (COF) manner. For example, the film having a conductive material may include an electrolytic copper foil film (TAB) or an electrolytic plating film (COF) formed on a polyimide layer.

In an exemplary embodiment, a connection between the sharing pads SP1 to SPi may be made at a step of manufacturing a chip (e.g., a display driver integrated circuit (DDI)) after a test operation of a wafer level.

The sharing switches SSW1 to SSWn may perform a test function and a charge sharing function.

To shorten a test time, a conventional display driver may include test switches for testing every channel. The test switches operate at a high voltage, and may cause the shrink issue. For example, reducing the size of the display driver may be limited due to the test switches. Further, the test switches limit a cell pitch and chip arrangement.

The display driver 100 according to an embodiment of the inventive concept includes the sharing switches SSW1 to SSWn having test and sharing functions. Accordingly, separate test switches are not needed. Thus, compared with the conventional display driver, the display driver 100 according to an embodiment of the inventive concept may result in a less limitation to shrinking the size of the display driver and a less limitation to a cell pitch by removing test switches.

Further, the display driver 100 according to an embodiment of the inventive concept may improve a charge sharing function by the sharing pads SP1 to SPi connected to each other via the FLR having a low resistance value.

Figure 2:
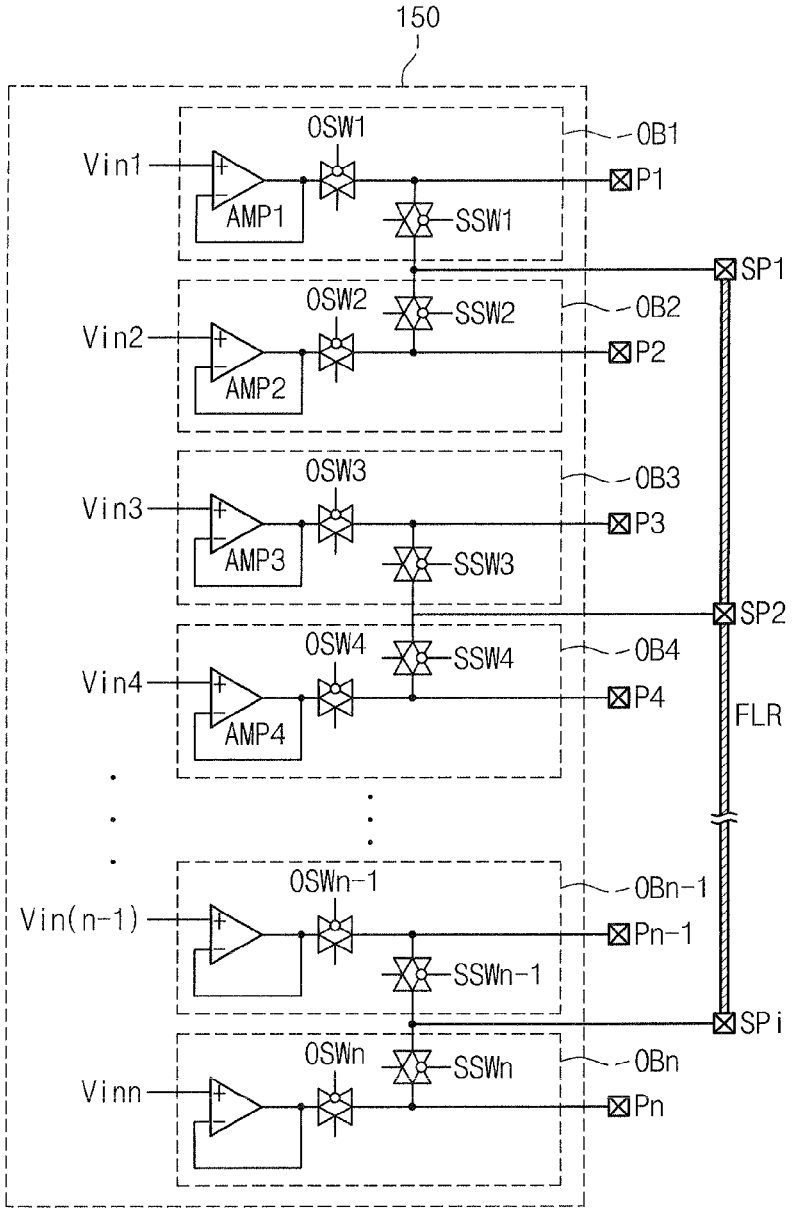
FIG. 2 is a circuit diagram schematically illustrating an output buffer unit as illustrated in FIG. 1.

FIG. 2 is a circuit diagram schematically illustrating an output buffer unit as illustrated in FIG. 1. Referring to FIG. 2, an output buffer unit 150 includes a plurality of output buffers OB1 to OBn.

A first output buffer OB1 includes an amplifier AMP1, an output switch OSW1, and a sharing switch SSW1. The amplifier AMP1 has a positive input terminal (+) receiving a voltage Vin1 and a negative input terminal (−) connected to an output terminal The voltage Vin1 may be output from a digital-to-analog converter 140. The output switch OSW1 transfers an output of the amplifier AMP1 to a first output pad P1 in response to an output control signal. The sharing switch SSW1 connects the first output pad P1 to a first sharing pad SP1 in response to a sharing control signal. The remaining output buffers OB2 to OBn are configured in the same or substantially the same way as the first output buffer OB1.

The output buffers OB1 and OB2 are connected to the first sharing pad SP1 for charge sharing via corresponding sharing switches SSW1 and SSW2. The output buffers OB3 and OB4 are connected to the second sharing pad SP2 for charge sharing via corresponding sharing switches SSW3 and SSW4. Likewise, output buffers of each pair may be connected to a corresponding sharing pad for charge sharing via corresponding sharing switches.

The sharing pads SP1 to SPi are connected to each other via FLR.

The output buffer 150 according to an embodiment of the inventive concept is configured such that at least two sharing switches are connected to at least one of the sharing pads SP1 to SPi.

Figure 3:
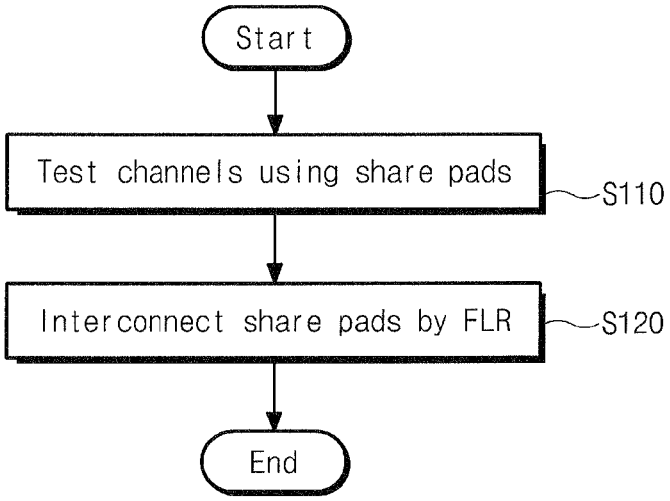
FIG. 3 is a flowchart describing a method of manufacturing a display driver according to an embodiment of the inventive concept.

FIG. 3 is a flowchart for describing a method of manufacturing a display driver according to an embodiment of the inventive concept. The method of manufacturing a display driver is described with reference to FIGS. 1 to 3.

In step S110, after an internal circuit of the display driver 100 is formed at a wafer level, channels corresponding to sharing switches SSW1 to SSWn are tested using the sharing pads SP1 to SPi.

In step S120, when a chip is judged as a good chip after the test operation, the sharing pads SP1 to SPi are connected to each other using FLR at a chip manufacturing step.

In the method of manufacturing the display driver 100 according to an embodiment of the inventive concept, a channel test operation is performed using sharing switches SSW1 to SSWn, and then the sharing pads SP1 to SPn are connected to each other.

Figure 4:
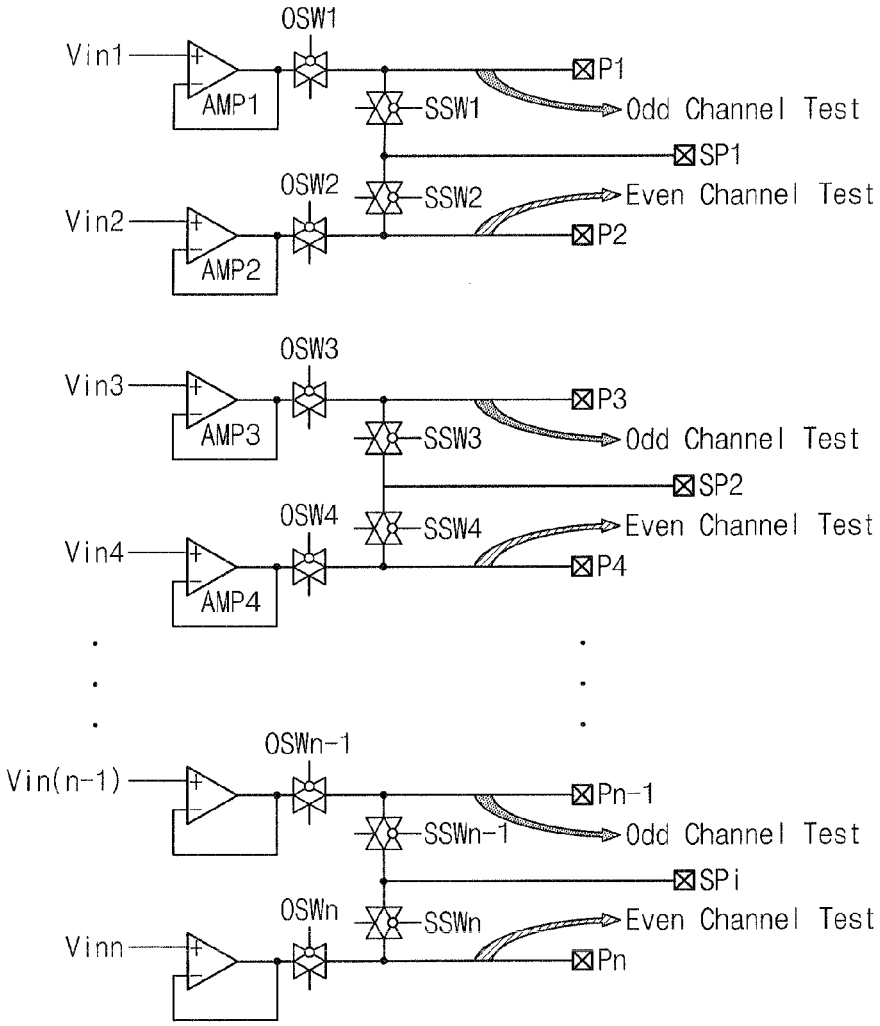
FIG. 4 is a diagram illustrating a test step as illustrating in FIG. 3.

FIG. 4 is a diagram illustrating a test step as illustrating in FIG. 3. Referring to FIG. 4, the sharing pads SP1 to SPi are used for an odd channel test operation or for an even channel test operation.

In an exemplary embodiment, a test operation may include an electrical die sorting (EDS) test operation of a wafer level.

In an exemplary embodiment, the odd and even channel test operations on respective channels may be performed at the same time. For example, at the odd channel test operation, output switches OSW1, OSW3, . . . , and OSWn-1 and sharing switches SSW1, SSW3, . . . , and SSWn-1 corresponding to odd channels are turned on at the same time. At the even channel test operation, output switches OSW2, OSW4, . . . , and OSWn and sharing switches SSW2, SSW4, . . . , and SSWn corresponding to even channels are turned on at the same time.

Figure 5:
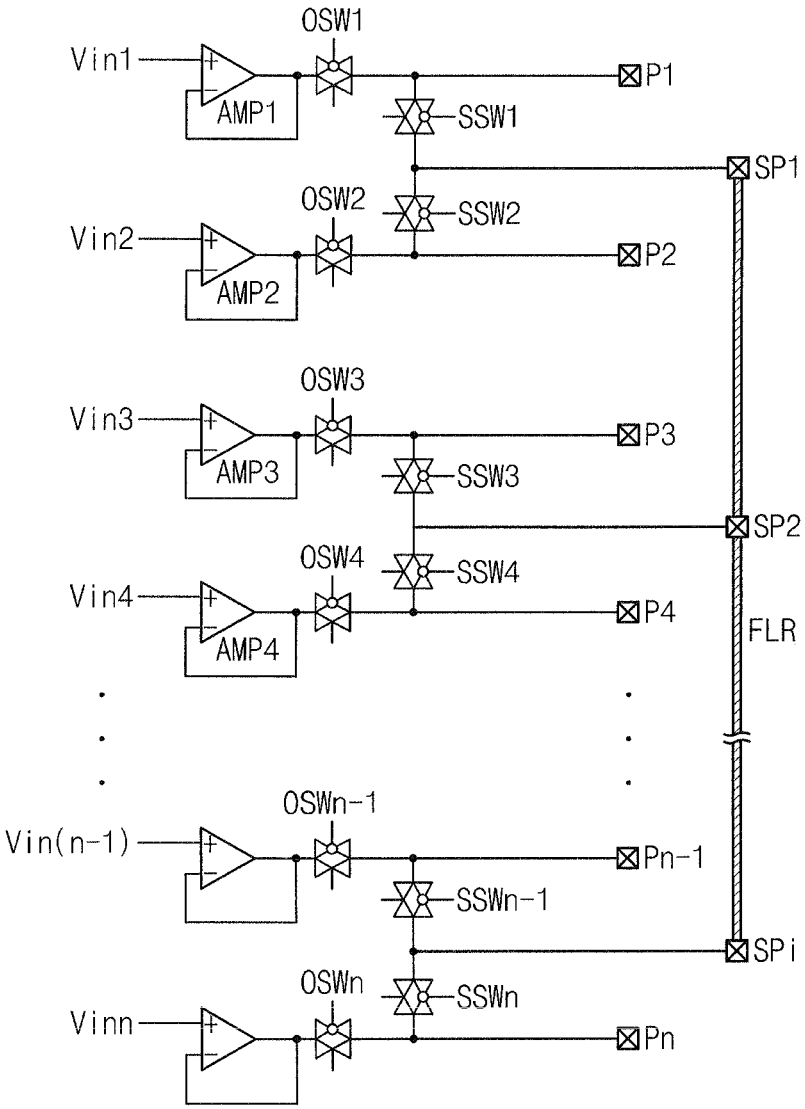
FIG. 5 is a diagram illustrating interconnection between sharing pads as illustrated in FIG. 3.

FIG. 5 is a diagram illustrating connections between sharing pads as illustrated in FIG. 3. Referring to FIG. 5, the sharing pads SP1 to SPi are connected to each other via FLR when assembling the display driver 150.

As illustrated in FIG. 5, the sharing pads SP1 to SPi are connected to each other by the FLR. However, the embodiments of the inventive concept are not limited thereto. The sharing pads SP1 to SPi can be connected to each other by various conductive materials at a chip assembling step.

Figure 6:
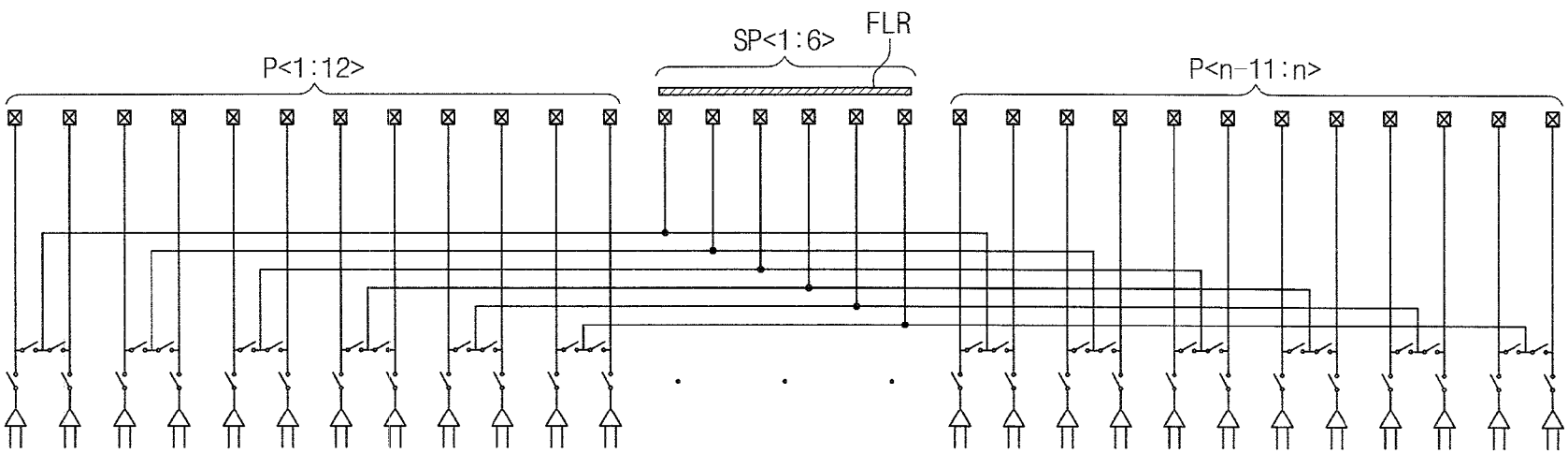
FIG. 6 is a diagram schematically illustrating an arrangement of output pads and sharing pads according to an embodiment of the inventive concept.

FIG. 6 is a diagram schematically illustrating an arrangement of output pads and sharing pads according to an embodiment of the inventive concept. Referring to FIG. 6, output pads are grouped. For example, each of output pad groups P<1:12>, . . . , and P<n−11:n> includes 12 output pads. Sharing pads SP1 to SP6 are disposed substantially at a center of the output pad groups. In FIG. 6, one output pad group includes 12 output pads. However, the embodiments of the inventive concept are not limited thereto. According to an embodiment, each output pad group can include at least two output pads.

Each of the sharing pads SP1 to SP6 is connected to one output pad of a corresponding one of the output pad groups via a sharing switch, and the sharing pads SP1 to SP6 are connected to each other via FLR. For example, the sharing pad SP1 may be connected to an output pad P1 of a first output pad group and an output pad P13 of a thirteen output pad group via sharing switches.

Figure 7:
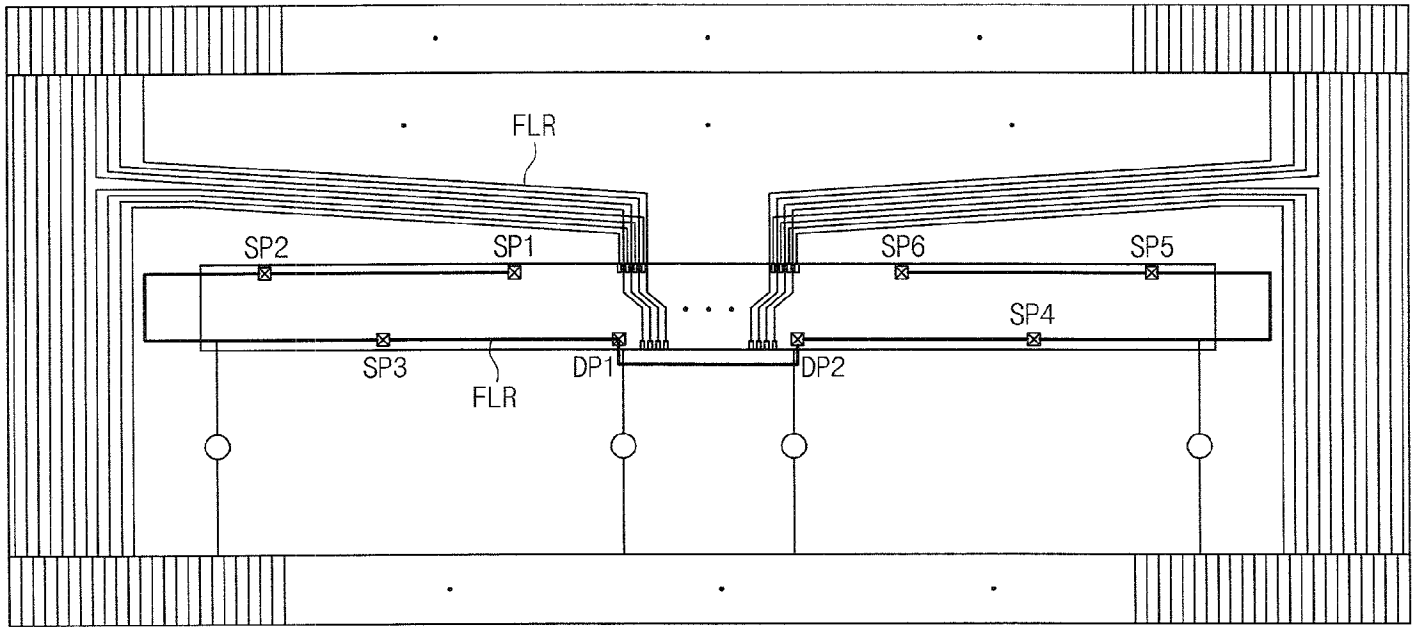
FIG. 7 is a diagram schematically illustrating a film used in a chip manufactured according to an embodiment of the inventive concept.

FIG. 7 is a diagram schematically illustrating a film used for chip manufacturing according to an embodiment of the inventive concept. Referring to FIG. 7, sharing pads SP1 to SP6 and dummy pads DP1 and DP2 are disposed to surround a center of a tape carrier packaged chip. The sharing pads SP1 to SP6 and the dummy pads DP1 and DP2 are connected to each other via FLR.

Figure 8:
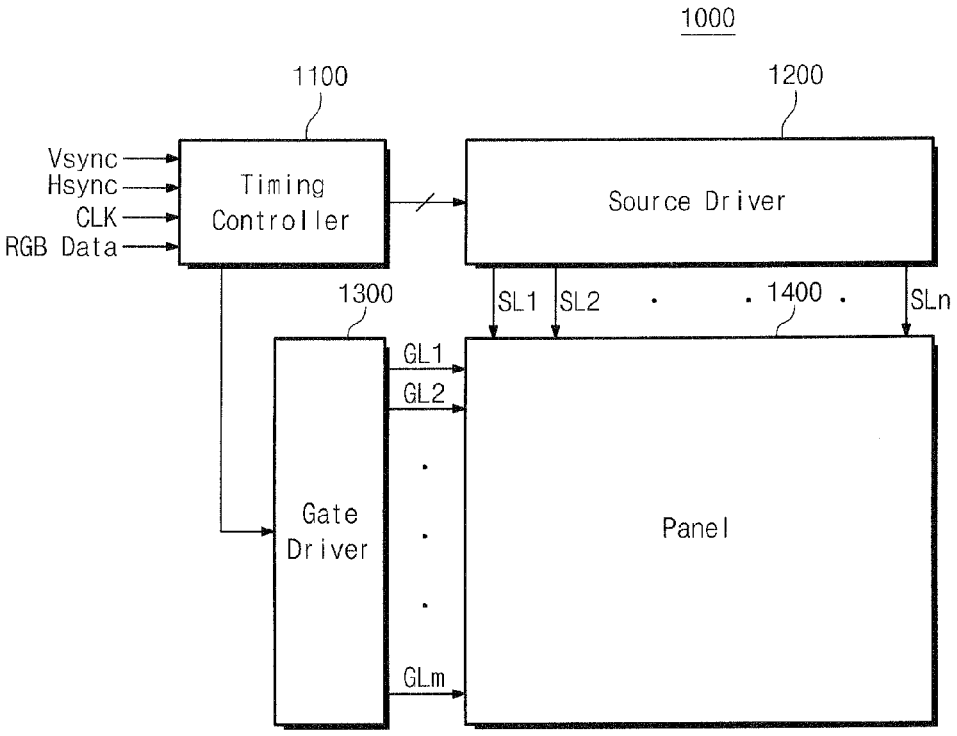
FIG. 8 is a block diagram schematically illustrating a display device according to an embodiment of the inventive concept.

FIG. 8 is a block diagram schematically illustrating a display device according to an embodiment of the inventive concept. Referring to FIG. 8, a display device 1000 includes a timing controller 1100, a source driver 1200, a gate driver 1300, and a display panel 1400.

The timing controller 1100 receives a vertical synchronization signal VSYNC, a horizontal synchronization signal HSYNC, a clock CLK, and RGB data on an input frame, and outputs RGB data, a vertical driver control signal (e.g., VSYNC) for controlling the source driver 1200 and a gate driver control signal (e.g., HSYNC) for controlling the gate driver 1300.

The source driver 1200 outputs gray scale voltages (also referred to as output signals) corresponding to the RGB data to source lines SL1 to SLn (n is a natural number) in response to the RGB data and the horizontal synchronization signal HSYNC from the timing controller 1100. The source driver 1200 may include amplifiers for outputting the gray scale voltages.

The source driver 1200 may have substantially the same configuration and operation as those of the display driver 100 illustrated in FIG. 1.

The gate driver 1300 receives the vertical synchronization signal VSYNC from the timing controller 1100 and controls gate lines GL1 to GLm to sequentially output analog data from the source driver 1200 to the gate lines GL1 to GLm.

The display panel 1400 includes a plurality of pixels that are respectively formed at intersections of the gate lines GL1 to GLm and the source lines SL1 to SLn. According to an embodiment, the display panel 1400 may be a non-emissive display panel that includes various display panels, such as a liquid crystal display panel, or an electrophoretic display panel. However, the embodiments of the present inventive concept are not limited thereto, and according to an embodiment, the display panel 1400 may also include an emissive display panel, such as an OLED display. For purposes of description, the display panel 1400 is a liquid crystal display panel.

A display device operates as follows. First, the timing controller 1100 receives RGB data indicating an image and control signals, such as vertical and horizontal synchronization signals VSYNC and HSYNC, from a graphic controller (not shown). The gate driver 1300 receives a gate line control signal, such as the vertical synchronization signal VSYNC, and sequentially shifts the input vertical synchronization signal VSYNC to sequentially control a plurality of gate lines GL1 to GLm. The source driver 1200 receives RGB data and a source driver control signal from the timing controller 1100 and outputs an image signal corresponding to a line to the display panel 1400 when the gate driver 1300 controls a gate line.

Figure 9:
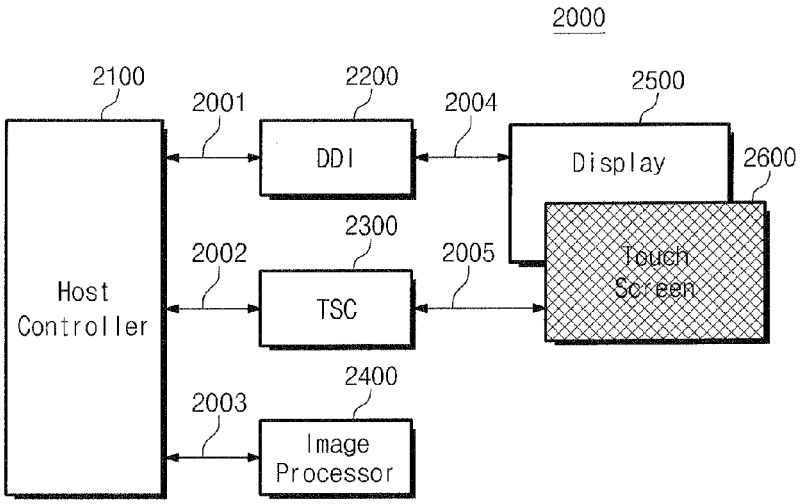
FIG. 9 is a block diagram schematically illustrating a data processing system according to an embodiment of the inventive concept.

FIG. 9 is a block diagram schematically illustrating a data processing system according to an embodiment of the inventive concept. Referring to FIG. 9, a data processing system 2000 includes a host controller 2100, a display driver integrated (DDI) circuit 2200, a touch screen controller (TSC) 2300, and an image processor 2400. In the data processing system 2000, the display driver integrated circuit 2200 is implemented to provide the display 2500 with display data 2004, and the touch screen controller 2300 is connected to a touch panel overlapping the display 2500 and is implemented to receive sensing data 2005 from the touch panel 2600. The display driver integrated circuit 2200 may have substantially the same configuration and operation as those of the display driver 100 in FIG. 1.

The constitutional elements other than the display driver integrated circuit 2200 in the data processing system 2000 are disclosed in detail in U.S. Patent Publication No. 2010/0241957, the entirety of which is incorporated by reference herein.

The data processing system 2000 is applicable to mobile phones including smart phones or tablet PCs.

As described above, a display driver and a method of manufacturing the display driver according to the embodiments of the inventive concept don't need separate test switches by providing sharing switches having test and sharing functions. Thus, the display driver of the inventive concept may result in a less limitation to reducing the size of the display driver and a less limitation to a cell pitch by removing test switches.

Further, it is possible to improve a charge sharing function by providing sharing pads connected to each other via a film having a low-resistance conductive material.

The above-disclosed subject matter is to be considered illustrative, and not restrictive, and the appended claims are intended to cover all such modifications, enhancements, and other embodiments, which fall within the true spirit and scope. Thus, to the maximum extent allowed by law, the scope is to be determined by the broadest permissible interpretation of the following claims and their equivalents, and shall not be restricted or limited by the foregoing detailed description.

What is claimed is:

1. A display driver comprising:

a serial-to-parallel converter configured to output parallel RGB data in response to a clock and serial RGB data;

a shift register unit configured to sequentially shift the clock and to store the shifted clock;

a data latch unit configured to receive the parallel RGB data based on the shifted clock;

a digital-to-analog converter configured to convert the parallel RGB data in the data latch unit to analog data using gamma reference voltages; and an output buffer unit configured to output the converted analog data to corresponding output pads, wherein the output buffer unit includes sharing switches respectively corresponding to the output pads, wherein the output pads are connected to sharing pads via the sharing switches, wherein during a test operation, at least two sharing switches connect at least one odd output pad and one even output pad to one of the sharing pads, and the sharing pads are not connected to each other, and wherein when the display driver is assembled after the test operation, the sharing pads are connected to each other via a film having a conductive material, and the sharing pads are configured to share charges of the output pads.

2. The display driver of claim 1, wherein the digital-to-analog converter is configured to alternately output a positive voltage and a negative voltage corresponding to the converted analog data in response to a polarity signal, wherein the positive voltage is higher than a reference voltage, and the negative voltage is lower than the reference voltage.

3. The display driver of claim 1, wherein the test operation includes an electrical die sorting (EDS) test operation of a wafer level.

4. The display driver of claim 1, wherein the test operation includes testing odd channels of the channels respectively corresponding to the output pads using the sharing pads and testing even channels of the channels respectively corresponding to the output pads using the sharing pads.

5. The display driver of claim 1, wherein at least two sharing switches of the sharing switches are connected to one of the sharing pads.

6. The display driver of claim 5, wherein the output buffer unit includes output buffers respectively corresponding to the output pads, and wherein at least one of the output buffers comprises:

an amplifier having a positive input terminal configured to receive the analog data and a negative input terminal connected to an output terminal;

an output switch connected to the output terminal and configured to output an output of the amplifier to a corresponding output pad in response to a switching control signal; and a sharing switch connected to the output pad and connecting the output pad to a corresponding sharing pad in response to a sharing control signal.

7. The display driver of claim 6, wherein a first channel corresponding to a first output pad and a second channel corresponding to a second output pad are connected to one of the sharing pads.

8. The display driver of claim 5, wherein the number of the sharing pads is 6.

9. The display driver of claim 5, wherein the sharing pads are disposed outside an internal chip of the display driver.

10. The display driver of claim 9, wherein when the sharing pads are connected to each other by the film, at least one dummy pad is connected with the sharing pads.

11. The display driver of claim 1, wherein the film has a resistance value below about 2.16Ω.

12. A method of manufacturing a display driver comprising:

performing a test operation on channels using at least two sharing switches respectively corresponding to sharing pads, wherein at least two sharing switches connect at least one odd output pad and one even output pad to one of the sharing pads, and the sharing pads are not connected to each other; and when the display driver is assembled after the test operation, connecting the sharing pads to each other via a film having a conductive material; and configuring the sharing pads to share charges of the output pads.

13. A display driver comprising:

a plurality of sharing switches, wherein at least one of the sharing switches is connected to an output switch and an output pad; and a plurality of sharing pads, wherein during a test operation, at least two sharing switches connect at least one odd output pad and one even output pad to one of the sharing pads, and the sharing pads are not connected to each other, wherein when the display driver is assembled after the test operation, the sharing pads are connected to each other via a film having a conductive material, and the sharing pads are configured to share charges of the output pads.

* * * * *